US006261089B1

(12) United States Patent
Aldo

(10) Patent No.: US 6,261,089 B1
(45) Date of Patent: Jul. 17, 2001

(54) FUEL GAS BURNER WITH LOW $NO_X$ CONTENT EMISSIONS

(75) Inventor: Polidoro Aldo, Vicenza (IT)

(73) Assignee: Industrie Polidoro A. SpA, Vicenza (IT)

( * ) Notice: Subject to any disclaimer, the term of this patent is extended or adjusted under 35 U.S.C. 154(b) by 0 days.

(21) Appl. No.: 09/533,512

(22) Filed: Mar. 23, 2000

(30) Foreign Application Priority Data

Nov. 15, 1999 (IT) ..... V199A0227

(51) Int. Cl.[7] ..... F23D 14/62
(52) U.S. Cl. ..... 431/354; 431/350; 431/181
(58) Field of Search ..... 431/354, 350, 431/8, 181, 349, 326, 328, 12, 114, 346; 126/21 A; 239/568; 48/180.1

(56) References Cited

U.S. PATENT DOCUMENTS

| | | | | |
|---|---|---|---|---|
| 1,466,356 | * | 8/1923 | Eddison | 431/354 |
| 1,642,426 | * | 9/1927 | Risinger | 431/349 |
| 1,863,100 | * | 6/1932 | Coleman | 239/407 |
| 4,907,964 | * | 3/1990 | Howarth et al. | 431/354 |
| 5,062,788 | * | 11/1991 | Best | 431/354 |
| 5,108,284 | * | 4/1992 | Gruswitz | 431/354 |
| 5,145,361 | * | 9/1992 | Kurzinski | 431/354 |
| 5,190,454 | * | 3/1993 | Murray et al. | 431/354 |
| 5,667,375 | * | 9/1997 | Sebastiani | 431/354 |
| 5,743,727 | * | 4/1998 | Rodgers | 431/328 |
| 6,027,336 | * | 2/2000 | Nolte et al. | 431/354 |

FOREIGN PATENT DOCUMENTS 3-158610 * 7/1991 (JP) .

* cited by examiner

*Primary Examiner*—Marvin M. Lateef
*Assistant Examiner*—Josiah C. Cocks
(74) *Attorney, Agent, or Firm*—Bucknam and Archer

(57) ABSTRACT

The burner is a fuel gas burner with low $NO_x$ content emissions, of the type having one or more units (1), provided with slits in whose correspondence the combustion develops, each of said units being fed the mixture composed by fuel gas and comburent air through a Venturi tube (2). The main characteristic of the burner object of the present invention lies in that a fan (6) is included that can supply in a continuous manner during the running of the burner, an air volume in the range 1–30% the air volume required as a whole by combustion.

2 Claims, 5 Drawing Sheets

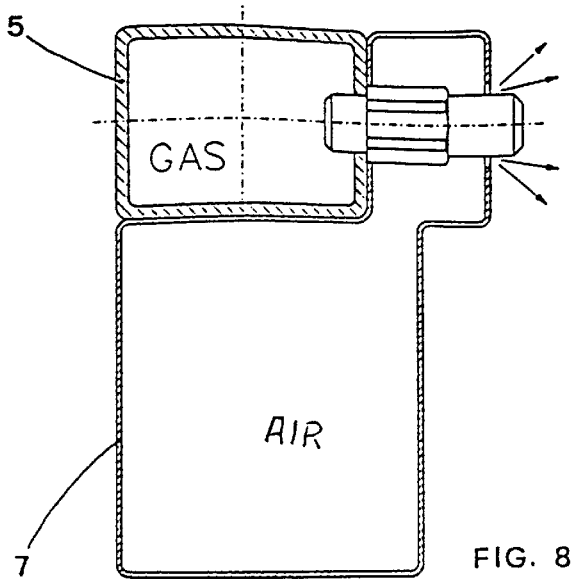
FIG. 8
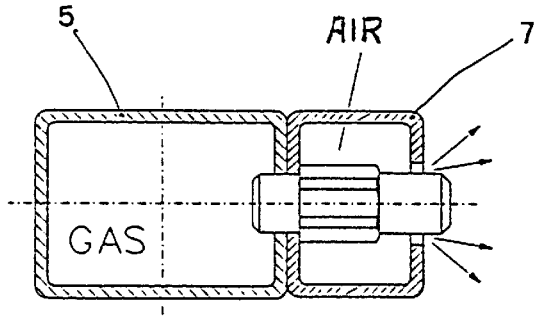
FIG. 9
FIG. 10
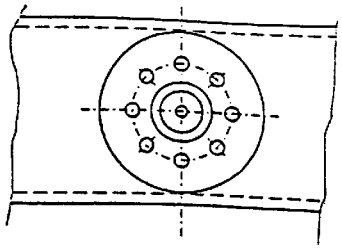
FIG. 11
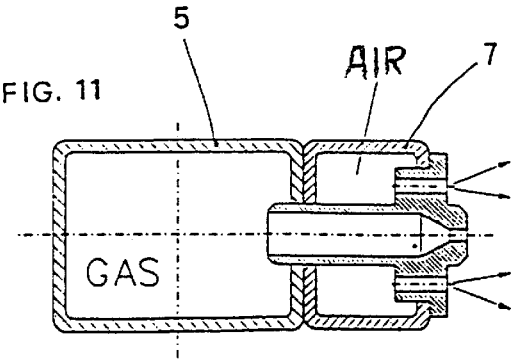

FUEL GAS BURNER WITH LOW $NO_X$ CONTENT EMISSIONS

The present invention relates to a fuel gas burner whose emissions have a low nitrogen oxide content ($NO_x$).

As is known, during the combustion step, a sucked air fuel gas burner inevitably produces CO and $NO_x$ in combustion products.

This has led, in the more developed countries, and in particular in the European Union and the US, to the drawing up of norms that shall become in force, sooner or later, suitable to set severe limitations to the percentages (or, more exactly, to the parts per million—p.p.m.) of these products contained in the gaseous emissions originating from combustion.

It is also known that today the apparatuses running with fuel gas, such as boilers, water heaters, etc., require increasingly higher combustion powers; this requirement clashes with the other requirement constituted by the fact that the market requires that the spaces occupied by these apparatuses be increasingly smaller, to allow their housing in apartments that tend to have smaller sizes with respect to the past ones.

These two clashing requirements obviously create to the designer enormous difficulties in the realization of burners suitable to provide low emissions, in particular of $NO_x$. However, in a period of a few years, a $NO_x$ reduction from 200 p.p.m. to 20–30 p.p.m. has been obtained.

The present sucked air, low $NO_x$ content burners, while working well, have all the same remarkable working limitations.

These limitations lie essentially in that:

- they have—the combustion surface being the same—a power reduced by about 10% with respect to the usual suction burners of the hypostoichiometric type;
- they cannot modulate the caloric power, as at about a half of their nominal power, the Venturi tube wherein the comburent air/gas mixing takes place has a reduced suction capacity; therefore, combustion that was of the hyperstoichiometric type at full power becomes hypostoichiometric, with the consequence that the burner head tends to become red-hot until it reaches the color of red steel, causing its destruction.

At present, the market requires burners having low $NO_x$ content in combustion products, high power, and being modulable, meaning that they should be able to work also in a regime far from maximum power.

This is not possible at present with the hyperstoichiometric burners of the known art. Object of this invention is to provide a burner of the so-called hyperstoichiometric type and as such able to cause reduced $NO_x$ emissions in combustion products, but also such as to be free from the above drawbacks.

This is achieved, according to the invention, by including in a burner of the hyperstoichiometric type a small fan, able to blow into the Venturi tube wherein the comburent air/fuel gas mixing takes place an air volume ranging from 1 to 30% with respect to the total volume necessary for combustion.

In this way, it is possible to obtain in the inside of the Venturi tube an introduction of air slightly greater with respect to that which would be obtained by the simple introduction of primary air sucked by the Venturi tube, which allows to burn more gas and to obtain very low $NO_x$ values (about 10–20 p.p.m.).

Thanks to the constant inlet of air coming from the fan of the Venturi tube, the flame remains always hyperstoichiometric, which prevents the very serious drawback of the abnormal heating of the burner head in low regime conditions.

Some embodiments of the invention will be now illustrated by way of non limiting examples wherein reference is made to the attached drawings, wherein:

FIGS. 5–11 (Tables IV–V) show various construction arrangements for the two collectors of the fuel gas and of the air coming from the fan to be utilized in the device according to the invention; in particular, FIGS. 10 and 11 show two different view of a same embodiment.

FIGS. 1–3 show that the invention relates to a burner, or more precisely, a plurality of units 1 of a known type and arranged side by side, also in this case according to known methods.

Each of these units has slits in whose correspondence the combustion takes place and therefore the flame develops.

Each of said individual burner units is fed fuel gas and comburent air through an own Venturi tube (3), wherein fuel gas in injected though a nozzle 4. The various nozzles lead to an individual collector 5.

Figure 1:
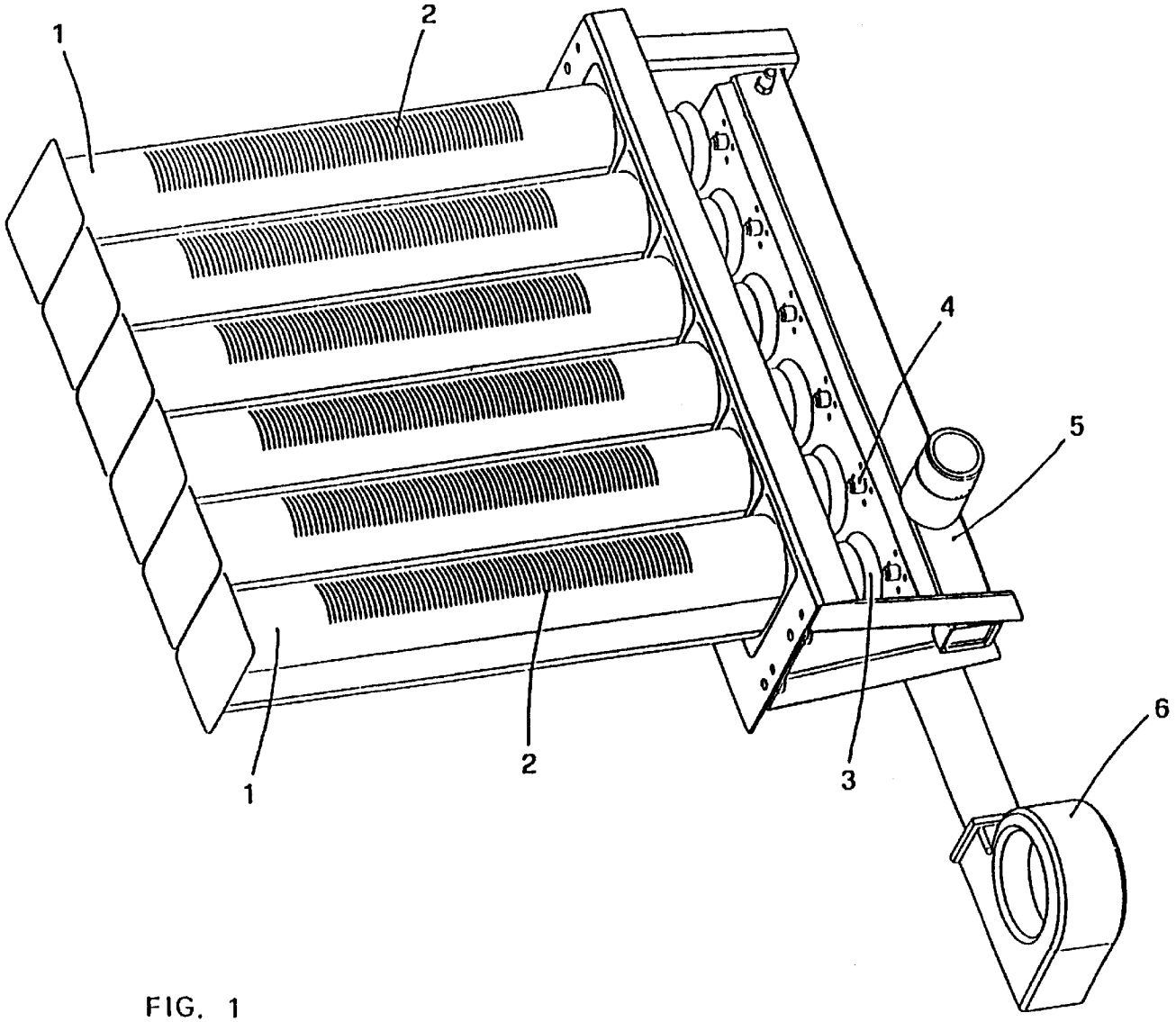
FIG. 1 (Table I) shows an overall axonometric view of the device according to the invention.
Figure 2:
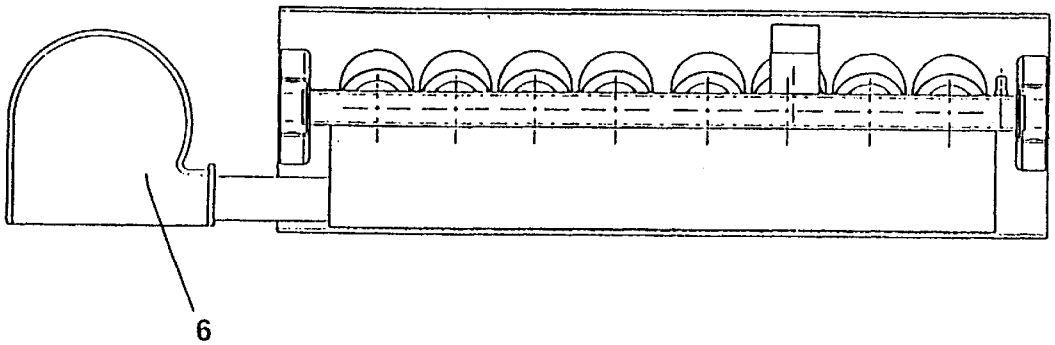
FIGS. 2 and 3 (Table II) show two views of the above device.
Figure 3:
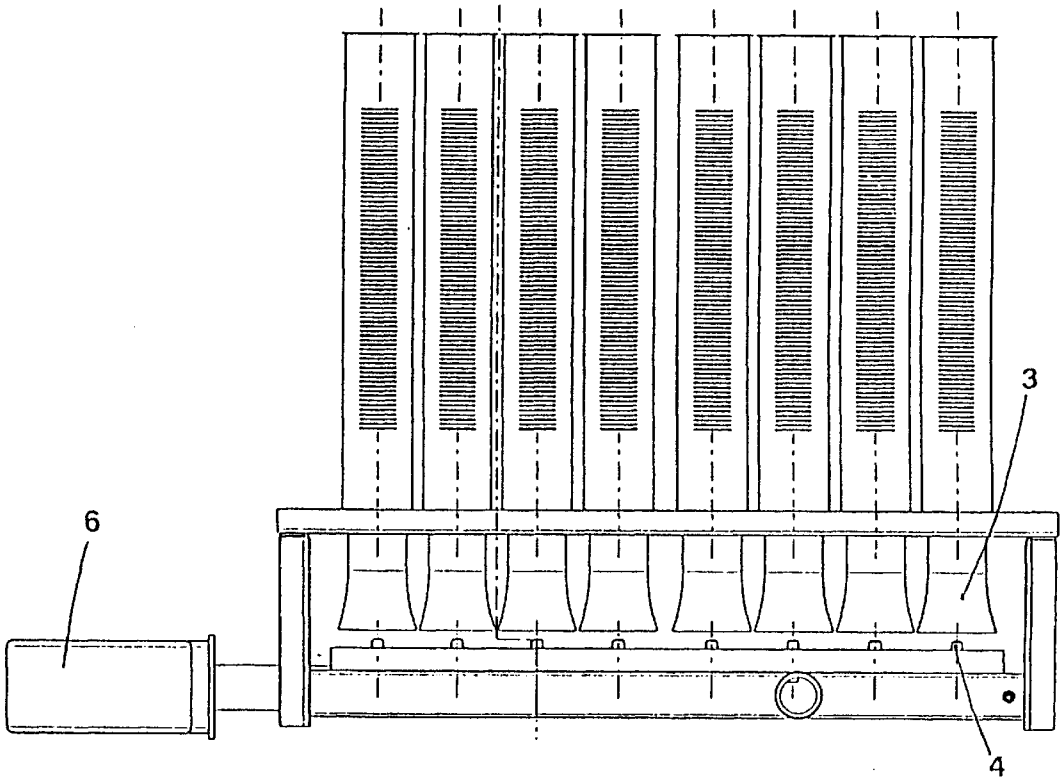
Figure 4:
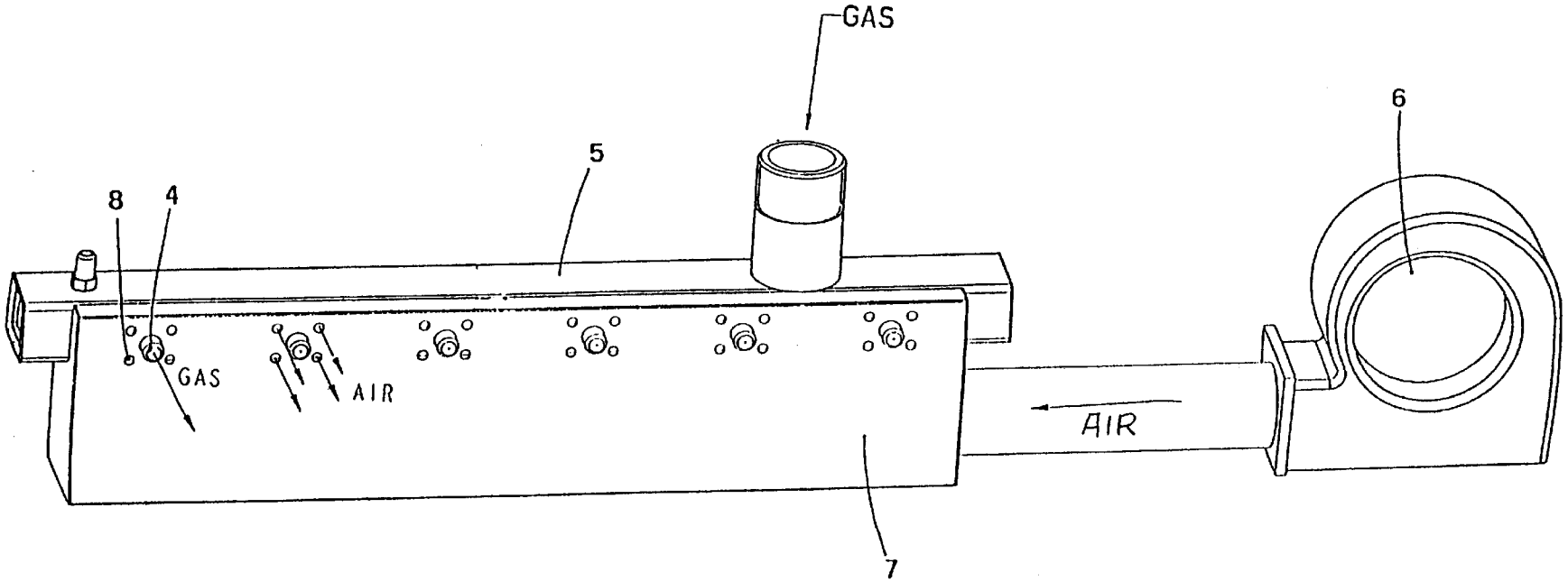
FIG. 4 (Table III) shows an axonometric view of the detail of the two collectors of the fuel gas and of the air coming from the fan that are included in the device according to the invention.
Figure 5:
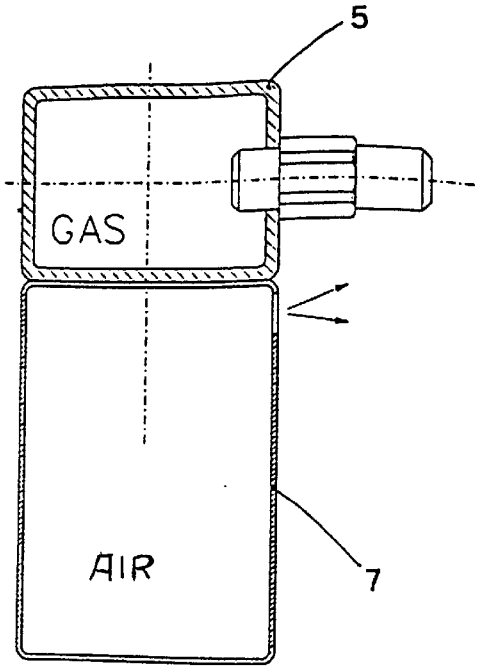
Figure 6:
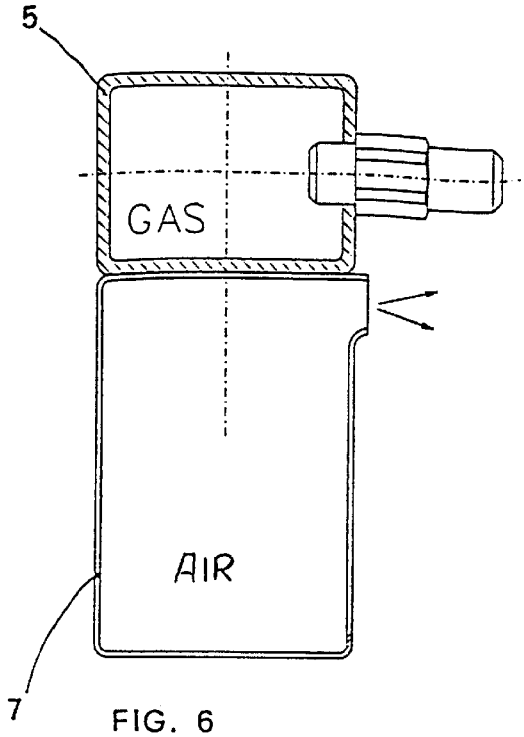
Figure 7:
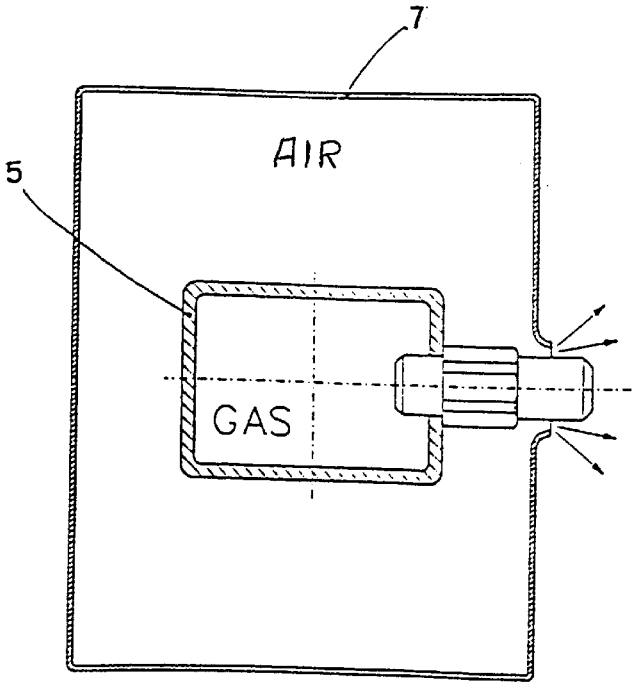

The basic characteristic of the device according to the invention lies in that it includes a fan 6 which works constantly and which lets air into a collector 7, wherefrom air exits through holes 8 located near nozzles 4 (FIG. 4).

In the practice, said fan shall be so sized as to supply approximately an amount of air in the range from 1 to 30% the total air to be let into the Venturi tube.

Of course, the remaining air will be sucked directly by the Venturi tube from the surrounding ambient.

Preferably, therefore, the fan will supply about 5% the air required by combustion. It should be noted that the shape of the individual burner units, their number and their configuration may be different from those illustrated in the figures, without for this departing from the patent scope.

It should also be noted that the utilization of fans in the burner sectors is well known: however, at present these fans are utilized to fed the burner only and not, as in the case at issue, to supply continuously that necessary "bit" of air which the burner would not be able to suck; in this way, the flame remains always hyperstoichiometric, preventing the heating of the burner head which might cause an imperfect combustion and, in some cases, the entire destruction of said burner.

The fan will have a constant rotation running, as it is not necessary to regulate the air/fuel gas ratio at the various pressures.

The collector of the additional air coming from the fan shall be so realized as to obstruct only very slightly the passage of the air sucked by the Venturi tube.

In this way, the "bit" of more air will be reduced to a minimal amount, with the consequence that the fan utilized may have a small size and be therefore little expensive. Besides, by introducing additional air in a reduced amount and at a constant capacity, the gas pressure on the emission may be reduced: in this way, the air utilized will not be excessive and the flame will not tend to detaching from the burner.

FIGS. 5–11 show some particular configurations of the complex of the two collectors of the fuel gas respectively the air coming from the fan; these construction arrangements proved very effective, but it is obvious that said collectors may have also different conformations without for this departing from the patent scope.

What is claimed is:

1. In a fuel gas burner having one or more units (1) arranged side by side, each unit having slits (2) wherein combustion with flame development takes place, each unit being fed the comburent air/fuel gas mixture by means of a Venturi tube (3) open to the atmosphere, fuel gas being let into the Venturi tube through a nozzle (4), the improvement comprising a fan (6) which lets into the Venturi tube an additional air volume in the range of 1 to 30% of the air volume required for combustion whereby the resulting combustion gases have low $NO_x$ content, said additional air and fuel gas being introduced to separate plenums such that the mixture of the additional air and fuel gas occurs within said Venturi tube.

2. The burner as defined in claim 1, wherein said separate plenums comprise a collector (5) for the fuel gas and a collector (7) for the additional air volume coming from said fan (6), said nozzle (4) for letting the fuel gas into said Venturi tube communicating with said fuel gas collector (5), and the additional air volume coming from said fan (6) is let into the Venturi tube through one or more holes arranged near said fuel gas nozzle (4) and communicating with said additional air volume collector (7).

* * * * *